US006254356B1

(12) United States Patent
Yamada et al.

(10) Patent No.: US 6,254,356 B1
(45) Date of Patent: Jul. 3, 2001

(54) FITTING STRUCTURE FOR CONTROLLING VALVE IN VARIABLE CAPACITY COMPRESSOR

(75) Inventors: Kiyohiro Yamada; Hiroyuki Nakaima; Masahiro Kawaguchi; Shingo Kumazawa, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/515,062

(22) Filed: Feb. 28, 2000

(30) Foreign Application Priority Data

Mar. 4, 1999 (JP) ..... 11-057237

(51) Int. Cl.[7] ..... F04B 1/26

(52) U.S. Cl. ..... 417/222.2; 417/454; 137/454.6; 137/625.65

(58) Field of Search ..... 417/222.2, 454; 137/454.6, 625.65

(56) References Cited

U.S. PATENT DOCUMENTS

| | | | | |
|---|---|---|---|---|
| 4,170,365 | | 10/1979 | Haaland | 277/207 |
| 5,513,673 | * | 5/1996 | Slavin et al. | 137/625.65 |
| 5,571,248 | * | 11/1996 | Seetharaman et al. | 137/625.65 |
| 5,651,387 | * | 7/1997 | Thor | 137/454.2 |
| 5,651,391 | * | 7/1997 | Connolly et al. | 137/625.65 |
| 5,687,997 | | 11/1997 | Beacom | 285/94 |
| 5,890,876 | * | 4/1999 | Suito et al. | 417/213 |
| 5,894,860 | * | 4/1999 | Baldauf et al. | 137/626.65 |
| 6,036,477 | * | 3/2000 | Kawaguchi et al. | 417/222.2 |
| 6,059,538 | * | 5/2000 | Kawaguchi et al. | 417/222.2 |

FOREIGN PATENT DOCUMENTS

| | | | |
|---|---|---|---|
| EP 0 220 798 A | | 5/1987 | (EP) . |
| EP 0 396 017 A | | 11/1990 | (EP) . |
| 62-87680 | * | 4/1987 | (JP) . |
| 62-131981 | * | 6/1987 | (JP) . |

OTHER PUBLICATIONS

EP 00 10 4353 Search Report dated 11/22/00.

* cited by examiner

*Primary Examiner*—Timothy S. Thorpe
*Assistant Examiner*—E D Hayes
(74) *Attorney, Agent, or Firm*—Woodcock Washburn Kurtz Mackiewicz & Norris LLP

(57) ABSTRACT

In a fitting structure of a control valve in a variable capacity compressor according to the present invention, a step portion 92 is formed by connecting two taper surfaces 93*a* and 93*b*, the diameter of each of which decreases progressively towards the depth of a fitting hole 32 (in an inserting direction of a control valve 33) between each step surface portion 57, 67, 74, 91 of a fitting hole 32. A first taper surface 93*a* at a deep part of each step portion 92 has a smaller inclination in the inserting direction than a second taper surface 93*b* on the inlet side. The first taper surface 93*a* is formed so that its inner diameter on the inlet side is a little greater than the outer diameter of each O-ring 61, 70, 77 disposed on each step surface portion 57, 67, 74 in a free condition.

14 Claims, 6 Drawing Sheets

FITTING STRUCTURE FOR CONTROLLING VALVE IN VARIABLE CAPACITY COMPRESSOR

BACKGROUND OF THE INVENTION

1. Field of the Invention

This invention relates to a fitting structure for a control valve for controlling a discharge capacity in a variable capacity compressor used for a car air conditioner, for example.

2. Description of the Related Art

The following construction is known for a variable capacity compressor (hereinafter called merely the "compressor") of the kind described above. A crank chamber is defined and partitioned inside a housing, and a drive shaft is rotatably supported by the housing in such a fashion as to cross, transversely, the crank chamber. A swash plate is supported by the drive shaft through a rotary support member inside the crank chamber in such a fashion as to be capable of integrally rotating and rocking. A plurality of pistons are engaged with to the outer peripheral portion of the swash plate. Cylinder bores are formed in a cylinder block, that constitutes a part of the housing, equiangularly arranged around the drive shaft. The head of each piston is fitted into each cylinder bore and is allowed to reciprocate.

When the drive shaft is driven for rotation by driving force transmitted thereto from an external driving source such as a car engine through a belt, or the like, the swash plate is rotated through the rotary support. The rotary motion of this swash plate is converted to the reciprocating motion of each piston. In consequence, a series of compression cycles such as suction of a refrigerant gas into the cylinder bores, compression of the refrigerant gas so sucked and discharge of the compressed refrigerant gas from the cylinder bores are repeated.

In the compressor described above, a discharge pressure region, in which the compressed refrigerant gas stays temporarily, and the crank chamber are connected through an supply passage having a control valve. The control valve is fitted into a fitting hole formed in a rear housing that constitutes a part of the housing of the compressor. This control valve plays the roles of changing an open area in the supply passage and regulating the feeding amount of the high-pressure discharge refrigerant gas into the crank chamber. When the feeding amount of the discharge refrigerant gas is adjusted, the internal pressure of the crank chamber is varied, and the pressure difference between the pressure of the crank chamber piston and the pressure of the cylinder bores through the piston is varied, too. As the pressure difference is varied, the tilt angle of the swash plate is varied, and the stroke of each piston, that is, the discharge capacity, is regulated.

The control valve shown in FIG. 7 is known as a control valve 200 of this kind. The control valve 200 includes a valve body 202 for opening and closing the supply passage 201 described above, an electromagnetic driving portion 203 for changing the load applied to the valve body 202 in accordance with an input current value, and a pressure-sensitive mechanism 205 for changing the load applied to the valve body 202 in accordance with the pressure of the suction pressure region of the compressor. In this control valve, the overall force of the impressed load from the pressure-sensitive mechanism 205 and the impressed load from the electromagnetic driving portion 203 operates the valve body 202, and the open area of the supply passage 201 is decided.

Gas chambers such as a valve chest 207 for storing the valve body 202 and a pressure-sensitive chamber 208 for storing the pressure-sensitive mechanism 205 are defined and partitioned inside the valve housing 206 of the control valve 200. A plurality of step portions 209*a* to 209*c* are defined in the valve housing 206. A pressure-sensitive hole 210 that communicates with the pressure-sensitive chamber 208 is open to the first step portion 209*a*. A valve port 211 that can be connected and disconnected to the valve chest 207 by the valve body 202 is open to the second step portion 209*b*. An inlet port 212 that communicates with the valve chest 207 is open to the third step portion 209*c*.

Each of these step portions 209*a* to 209*c* is partitioned hermetically by an O-ring 214 while the control valve 200 is fitted to the fitting hole 213 of the compressor. This is because different pressures are guided to the pressure-sensitive hole 210, the valve port 211 and the inlet port 212, respectively.

A taper surface 216 the diameter of which decreases progressively towards the bottom of the fitting hole 213 is formed in the fitting hole 213 in such a fashion as to correspond to a holding portion 215 of the O-ring 214 as shown in FIGS. 5B and 7. As the O-ring 214 passes over the taper surface 216 during the fitting operation of the control valve, it is compressed in a predetermined quantity.

Incidentally, the compressor is mounted in the proximity of the engine inside the car engine room. The mounting space of the compressor inside the engine room is limited, and there has been a strong requirement for reducing the size of the compressor, particularly the requirement for reducing its projecting distance from the outer periphery in the diametric direction of the housing 217.

In the compressor having the conventional construction described above, its control valve 200 includes the electromagnetic driving portion 203 and the pressure-sensitive mechanism 205. Therefore, it is elongated in the axial direction. As indicated by two-dot-chain line in FIG. 3, the control valve 200 is fitted while its proximal end portion protrudes from the outer periphery of the housing 217 of the compressor. When this protruding distance is great, the control valve 200 interferes with the car engine or other auxiliary machinery, and mountability of the compressor to the car is poor.

To cope with this problem, the full length of the control valve 200 in the axial direction may be reduced. In this case, the reduction of the length in the axial direction is limited because the electromagnetic driving portion 203 and the pressure-sensitive mechanism 205 have to apply predetermined impressed loads to the valve body 202 inside the control valve 200. In other words, if the length of electromagnetic driving portion 203 and the pressure-sensitive mechanism 205 are greatly decreased in the axial direction, the predetermined impressed loads are likely to be insufficient, and the regulation capability of the valve body 202 of adjusting the open area to the supply passage 201 may drop. In consequence, stability of discharge capacity control in the compressor may drop.

Therefore, the length in the axial direction must be reduced at the intermediate portion between the electromagnetic driving portion 203 and the pressure-sensitive mechanism 205 in the valve housings 206. In this case, the width of the second and third step portions 209*b* and 209*c* becomes small. Consequently, the distances between the O-rings 214 that separate them and the distances between the pressure-sensitive hole 210, the valve port 211 and the inlet port 212 opening to the step portions 209*a* to 209*c* become short, too.

The distances between the taper surfaces 216 inside the fitting hole 213 become short, as well. The requirement for machining accuracy of the pressure detecting passage 218 and the supply passage 201 that open to oppose the pressure-sensitive hole 210, the valve port 211 and the inlet port 212 on the inner peripheral surface of the fitting hole 213, becomes higher with the result that the production cost of the compressor becomes higher.

A predetermined open area must be secured, in some cases, in each of the supply passage 201 and the pressure detecting passage 218 in order to restrict an excessive pressure loss. In such a case, a part of each passage extends over the taper surface 216. When a part of the pressure detecting passage 218 or the supply passage 201 is open over the taper surface 216, the O-ring 214 is damaged when it passes over the taper surface 216 while being compressed, and a pressure leak is more likely to occur. In consequence, capacity control in the compressor becomes unstable.

If the inclination of the taper surface 216 is increased in order to avoid the possible damage of the O-ring 214, the problem that a part of the pressure detecting passage 218 and the supply passage 201 is open over the taper surface 216 can be avoided. However, because the O-ring 214 is drastically compressed, the resistance increases remarkably when the control valve 200 is inserted, and the assembling property of the control valve 200 to the compressor drops. In this case, too, the production cost of the compressor becomes higher.

SUMMARY OF THE INVENTION

In view of the problems of the fitting structures of the prior art described above, the present invention is directed to provide a fitting structure of a control valve in a variable capacity compressor which fitting structure makes it easy to fit the control valve without inviting the increase of the production cost and the drop of capacity controllability in the compressor.

To accomplish this object, the fitting structure of the control valve according to a preferred embodiment of the present invention has the following structure. In a fitting structure of a control valve in a variable capacity compressor of the type which includes a plurality of step portions in appearance and in which a hole communicating with a gas chamber defined inside the control valve is open to at least one of the step portions and each of the step portions is partitioned by a seal member under the condition where the control valve is fitted into a fitting hole of the variable capacity compressor, the fitting structure according to the present invention is characterized in that the fitting hole has a plurality of step portions so formed as to correspond to seal member holding portions of the control valve, each of the step portions is shaped into an inclined surface the diameter of which progressively decreases from the inlet side towards the bottom in an inserting direction of the control valve, and a diameter reduction amount per unit moving distance of the control valve on the inclined surface is greater on the inlet side of the inclined surface than on the depth side.

According to this embodiment, the inclination of the inclined surface on the inlet side can be increased while the other side has a small inclination in the inserting direction of the control valve. Because the seal member is compressed by the bottom portion of the inclined surface, the increase in the resistance at the time of fitting of the control valve can be avoided. On the other hand, because the inclination on the inlet side of the inclined surface is increased, the width of the slope can be made smaller than when the slope comprises a single small inclination. In consequence, the open area of the pressure detecting passage and the supply passage in the fitting hole of the compressor can be secured sufficiently while the length in the axial direction of the control valve is reduced.

In a fitting structure of a control valve in a variable capacity compressor of the type which includes a plurality of step portions in appearance and in which a hole communicating with a gas chamber defined inside the control valve is open to at least one of the step portions and each of the step portions is partitioned by a seal member under the condition where the control valve is fitted into a fitting hole of the variable capacity compressor, the fitting structure of a control valve according to the present invention is characterized in that the fitting hole has a plurality of step portions so formed as to correspond to seal member holding portions of the control valve, and each of the step portions forms a curve surface having a different radius of curvature from the inlet side towards the other side in the inserting direction of the control valve.

According to this embodiment, the curve surfaces are formed so that their radii of curvature become gradually greater from the inlet side towards the other side. Therefore, the inclination of the control valve at the step portion in the inserting direction can be made greater towards the inlet side while the increase of the resistance at the time of fitting of the control valve is avoided.

The present invention may be more fully understood from the description of preferred embodiments of the invention set forth below, together with the accompanying drawings.

DESCRIPTION OF THE PREFERRED EMBODIMENTS

Hereinafter, an embodiment wherein the present invention is applied to the fitting structure of a control valve of a single-head piston, swash type variable capacity compressor, will be explained with reference to FIGS. 1 to 5.

To begin with, the general construction of the variable capacity compressor (hereinafter called merely the "compressor") will be explained.

Figure 2:
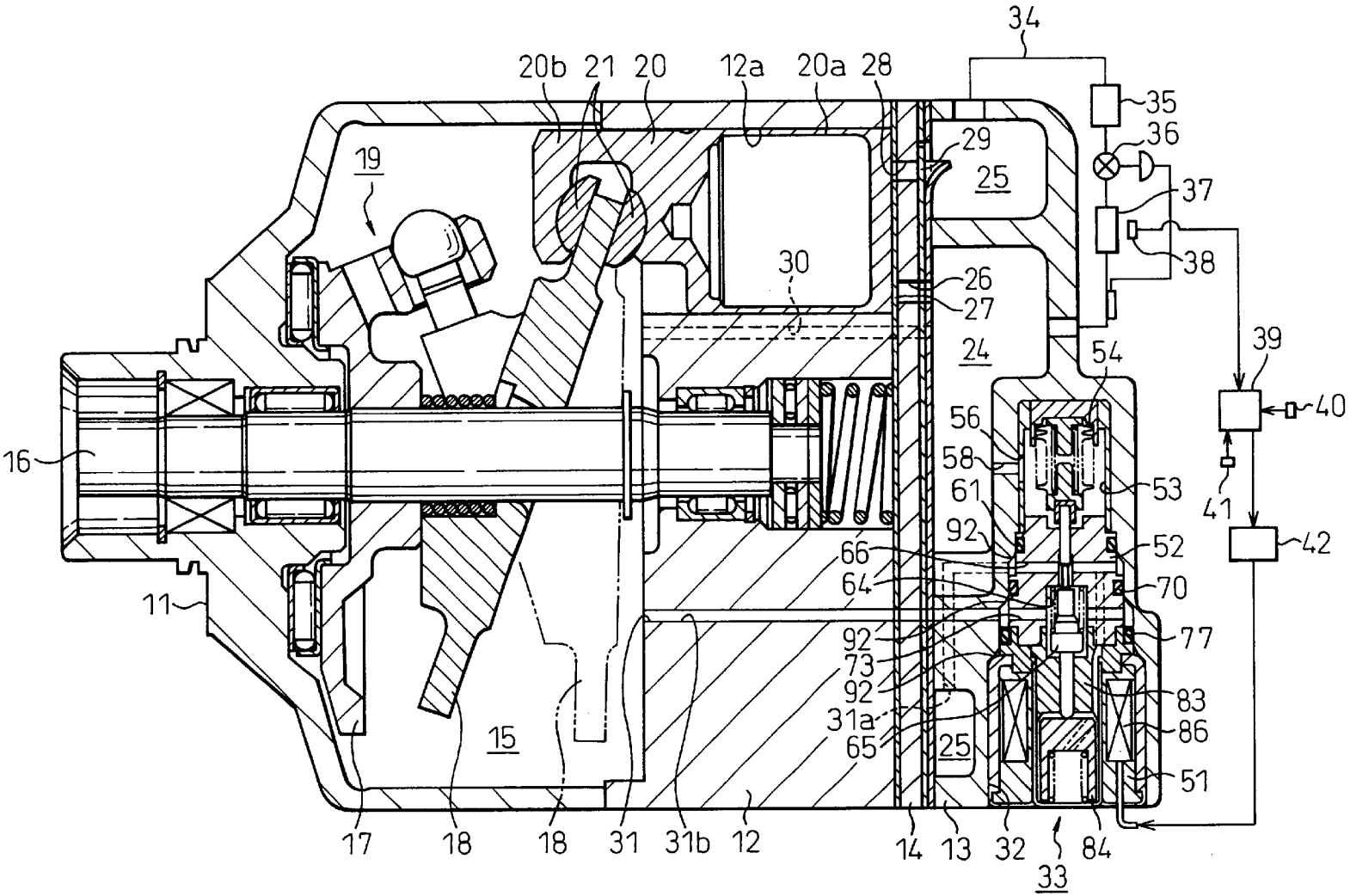
FIG. 2 is a sectional view showing a variable capacity compressor equipped with the fitting structure of the control valve shown in FIG. 1.

A front housing 11 is joined and fixed to the front end of a cylinder block 12 as shown in FIG. 2. A rear housing 13 is joined and fixed to the rear end of the cylinder block 12 through a valve plate 14. The front housing 11, the cylinder block 12 and the rear housing 13 together constitute the housing of the compressor.

A crank chamber 15 as a pressure chamber is defined and encompassed by the front housing 11 and the cylinder block 12. A drive shaft 16 is supported by, and extends between, the front housing 11 and the cylinder block 12 in such a manner as to cross the crank chamber 15 and to be capable of rotating. The front end side of this drive shaft 16 is connected to an external driving source such as a car engine through pulleys, belts, and the like, that are not shown, and is caused to rotate by the driving force from the car engine.

A lug plate 17 is fixed to the drive shaft 16 inside the crank chamber 15, and the drive shaft 16 is inserted through a swash plate 18 as a cam plate. This swash plate 18 is interconnected to the lug plate in such a manner as to be capable rotating with the lug plate 17 through a hinge mechanism 19. The hinge mechanism 19, the swash plate 18 and the drive shaft 16 are fitted to one another in such a fashion that the swash plate 18 can slide while inclining with respect to the drive shaft 16 in the axial direction of the driving shaft 16.

When the radial center portion of the swash plate 18 slides and moves towards the cylinder block 12 as indicated by two-dot-chain lines in FIG. 2, the tilt angle of the swash plate 18 decreases. On the other hand, when the radial center portion of the swash plate 18 slides and moves towards the lug plate 17 as indicated by solid lines in FIG. 2, the tilt angle of the swash plate 18 increases.

A plurality (six, for example) of cylinder bores 12*a* are formed in the cylinder block 12 equiangularly round the axis of the drive shaft 16 with predetermined distances between them. Each cylinder bore 12*a* accommodates therein the head portion 20*a* of a singlehead type piston 20 in such a manner as to allow its reciprocation. The neck (20*b*) side of each piston 20 is engaged with to the outer peripheral portion of the swash plate 18 through a pair of shoes 21. In consequence, the rotary motion of the drive shaft 16 is converted to the longitudinal reciprocating motion of the head portion 20*a* of the piston 20 inside the cylinder bore 12*a* through the lug plate 17, the hinge mechanism 19, the swash plate 18 and the shoe 21.

A suction chamber 24 as a pressure chamber that constitutes a suction pressure region and a discharge chamber 25 as a pressure chamber that constitutes a discharge pressure region are partitioned and defined inside the rear housing 13. Suction ports 26, suction valves 27, discharge ports 28 and discharge valves 29 are formed in the valve plate 14 in such a manner as to correspond to the cylinder bores 12*a*, respectively. The suction port 26 communicates the suction chamber 24 with each cylinder bore 12*a*, and the suction valve 27 opens and closes the suction port 26. The discharge port 28 communicates the discharge chamber 25 with each cylinder bore 12*a*, and the discharge valve 29 opens and closes this discharge port 28.

When the drive shaft 16 is driven and rotated by an external driving source, not shown, and the piston 20 is moved from the upper dead point towards the lower dead point, the refrigerant gas inside the suction chamber 24 is sucked into the cylinder bores 12*a* through the suction port 26 while pushing away the suction valve 27. The refrigerant gas sucked into the cylinder bores 12*a* in this way is compressed to a predetermined pressure due to the movement of the piston from the lower dead point side towards the upper dead point side. The refrigerant gas so compressed is discharged into the discharge chamber 25 while pushing away the discharge valve 29.

The crank chamber 15 and the suction chamber 24 are communicated with each other by a bleeding passage 30. The discharge chamber 25 and the crank chamber 15 are communicated with each other as an supply passage 31, that is, a communication passage. A control valve 33 is fitted to an intermediate part of this supply passage 31 inside a fitting hole 32 that is formed at the rear end portion of the rear housing 13.

An external refrigerant circuit 34 communicates the suction chamber 24 and the discharge chamber 25. This external refrigerant circuit 34 includes a condenser 35, an expansion valve 36 and an evaporator 37. The external refrigerant circuit 34 and the compressor, that has the construction described above, together constitute a refrigerating circuit. An evaporator temperature sensor 38 is disposed in the proximity of the evaporator 37, detects the temperature of the evaporator 37 and outputs this detection temperature information to a controlling computer 39. A cabin temperature setter 40 for setting the temperature inside the cabin of the car and a cabin temperature sensor 41, for example, are connected to the controlling computer 39.

The controlling computer 39 gives an input current value to a driving circuit 42 on the basis of external signals such as the room temperature set in advance by the cabin temperature setter 40, the detection temperature acquired from the evaporator temperature sensor 38 and the detection temperature acquired from the cabin temperature sensor 41, for example. The driving circuit 42 outputs and applies the instructed input current value to a coil 86 of the control valve 33 described later.

Next, the control valve 33 will be explained.

Figure 1:
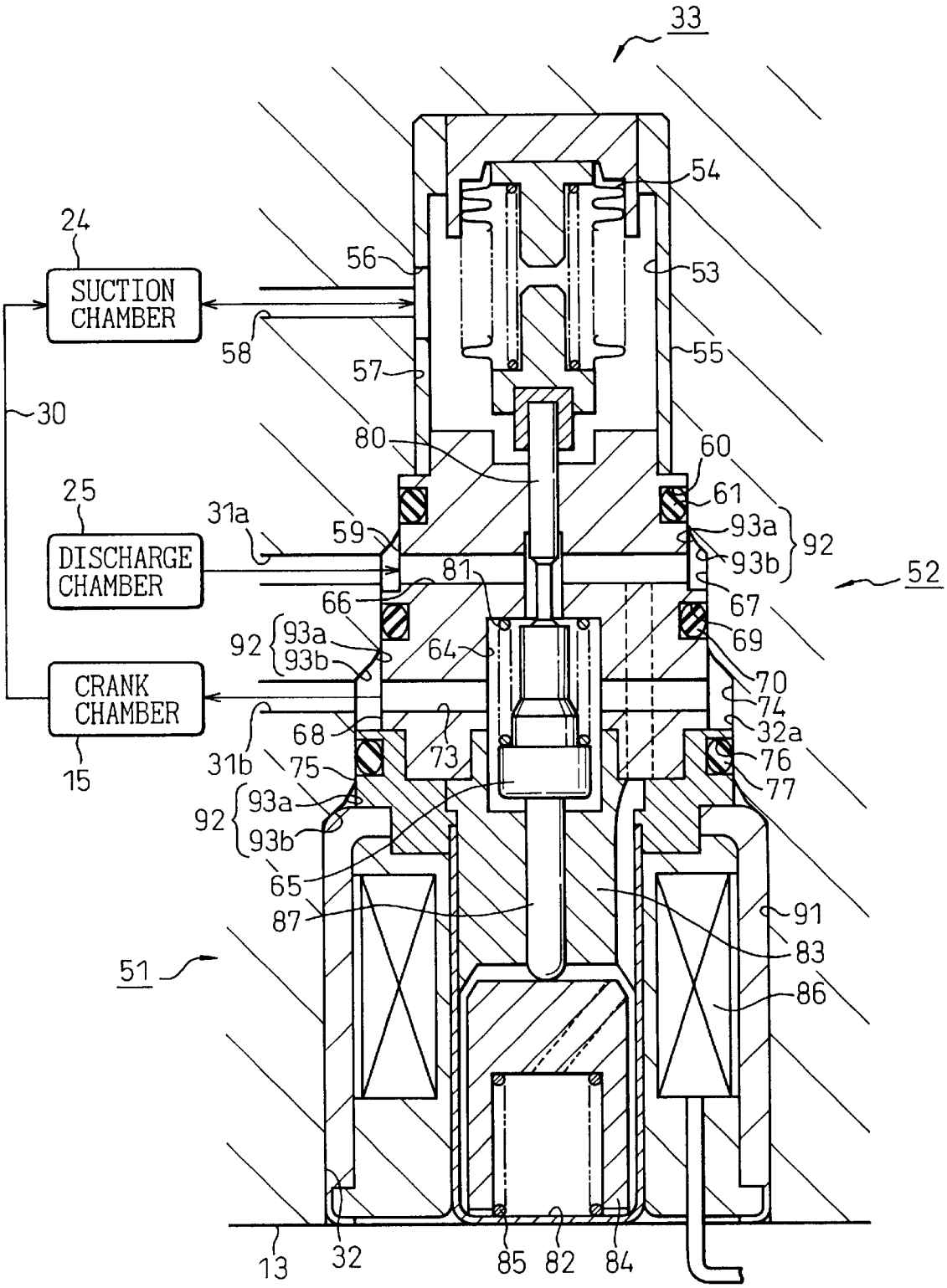
FIG. 1 is a sectional view showing a fitting structure of a control valve according to one embodiment of the present invention.

The control valve 33 has a construction in which an electromagnetic driving portion 51 and a valve housing 52 are joined at the center as shown in FIG. 1. A pressure-sensitive chamber 53 as a gas chamber is partitioned and defined on the distal end side inside the valve housing 52. Bellows 54 are accommodated in this pressure-sensitive chamber 53. A first step portion 55 is formed on the outer peripheral surface of the portion of the valve housing 52 that corresponds to the pressure-sensitive chamber 53. A pressure-sensitive hole 56 communicating with the pressure-sensitive chamber 53 is open to the first step portion 55. The inner peripheral surface 32*a* of the fitting hole 32 in the rear housing 13 opposing the first step portion 55 functions as a first step surface portion 57. A pressure detecting passage 58, that serves as a communication passage communicating with the suction chamber 24, is open at the position on the first step surface portion 57 that opposes the pressure-sensitive hole 56.

A second step portion 59 is formed on the outer peripheral surface of the valve housing 52 in such a manner as to continue the first step portion 55. A first O-ring holding portion 60 which is in the shape of an annular groove is formed on the distal end side of the second step portion 59, and holds a first O-ring 61 as a seal member. The first O-ring 61 hermetically partitions to seal the space between the first step portion 55 and the first step surface portion 57 opposing the former. The suction pressure Ps inside the suction chamber 24 is guided into the pressure-sensitive chamber 53 through the pressure detecting passage 58 and the pressure-sensitive hole 56.

A valve chest 64 as a gas chamber is partitioned and defined inside the valve housing 52 on the side of the electromagnetic driving portion 51, and a valve body 65 for regulating the open area of the supply passage 31 is accommodated in the valve chest 64. A valve port 66 that communicates with the valve chest 64 is open to the position opposing the valve body 65 of the valve chest 64 on one hand, and is open onto the second step portion 59, on the other.

The inner peripheral surface 32*a* of the fitting hole 32 in the rear housing 13, opposing the second step portion 59, functions as a second step surface portion 67. An upstream side supply passage 31*a* communicating with the discharge chamber 25 is open at a position opposing the valve port 66 on this second step surface portion 67.

A third step portion 68 is formed on the outer peripheral surface of the valve housing 52 in such a manner as to continue the second step portion 59. A second O-ring holding portion 69 which is in the shape of an annular groove is formed on the distal end side of the third step portion 68, and a second O-ring 70 as a seal member is held by this second O-ring holding portion 69.

The second O-ring 70 and the first O-ring 61 described above hermetically partition to seal the space between the second step portion 59 and the second step surface portion 67 opposing the second step portion 59. The discharge pressure Pd inside the discharge chamber 25 is guided into the valve port 66 through the upstream side supply passage 31*a*.

The third step portion 68 is the portion that corresponds the valve chest 64 of the outer peripheral surface of the valve housing 52. An supply hole 73 that communicates with the valve chest 64 is open to the third step portion 68. The inner peripheral surface 32*a* of the fitting hole 32 in the rear housing 13 opposing the third step portion 68, serves as the third step surface portion 74. A downstream side supply passage 31*b* communicating with the crank chamber 15 is open at the position on the third step surface portion 74 that opposes the supply hole 73.

A fourth step portion 75, as still another step portion, is formed on the outer peripheral surface of the valve housing 52 in such a manner as to continue the third step portion 68. A third O-ring holding portion 76 which is in the shape of an annular groove is formed on the distal end side of this fourth step portion 75, and a third O-ring 77 as a seal member is held by this third O-ring holding portion 76. The third O-ring 77 and the second O-ring 70 hermetically partition to seal the space between the third step portion 68 and the third step surface portion 74 opposing the former. The crank chamber pressure Pc inside the crank chamber 15 is guided into the valve chest 64 through the downstream side supply passage 31*b* and the supply hole 73. In this way, the valve chest 64 and the valve port 66 constitute a part of the supply passage 31.

A pressure-sensitive rod 80 is formed integrally with the valve body 65, and the bellows 54 and the valve body 65 are operatively connected through this pressure-sensitive rod 80. In other words, the bellows 54 extend and contract in accordance with the change of the suction pressure Ps, and the biasing force corresponding to the change of the suction pressure Ps is transmitted to the valve body 65 through the pressure-sensitive rod 80.

A compulsive opening spring 81 is disposed between the valve body 65 and the inner wall surface of the valve chest 64 opposing the valve body 65. The valve body 65 opens the valve port 66 by the operation of this compulsive opening spring 81 under the non-operative condition of the bellows 54 and the electromagnetic driving portion 51.

The electromagnetic driving portion 51 is joined in such a manner as to continue the fourth step portion 75 of the valve housing 52. A plunger chamber 82 is partitioned and defined inside the electromagnetic driving portion 51 on the opposite side to the pressure-sensitive chamber 53 relative to the valve chest 64. A fixed iron core 83 is fitted to an upper opening of the plunger chamber 82. A movable iron core 83 is so accommodated in the plunger chamber 82 as to oppose the fixed iron core 83. A follower spring 85 is interposed between the movable iron core 84 and the bottom surface of the plunger chamber 82 and biases the movable iron core 84 towards the valve chest 64. A coil 86 is disposed outside the fixed iron core 83 and the movable iron core 84 in such a manner as to bridge over both iron cores 83 and 84. The driving circuit 42 described above is connected to this coil 86 so that the electromagnetic force corresponding to the input current value from the driving circuit 42 can be generated.

An electromagnetic driving rod 87 is formed integrally with the valve body 65 on the opposite side to the pressure-sensitive rod 80. The end portion of this electromagnetic driving rod 87 on the side of the movable iron core 84 is brought into contact with the movable iron core 84 by the biasing force of the follower spring 85 and the compulsive opening spring 81. In consequence, the movable iron core 84 and the valve body 65 are operatively connected through the electromagnetic driving rod 87, and the biasing force corresponding to the electromagnetic force generated in the coil 86 is transmitted to the valve body 65.

Next, the changing operation of the discharge capacity by the compressor having the construction described above will be explained.

When the detection temperature acquired from the cabin temperature sensor 41 is higher than the set temperature of the cabin temperature setter 40, the controlling computer 39 gives the instruction to the driving circuit 42 to supply a predetermined current to the coil 86 of the control valve 33. As the supply of the current to the coil 86 is started, the attraction force (electromagnetic force) is generated in accordance with the input current value between both iron cores 83 and 84. This attraction force is transmitted to the valve body 65 as the load in the approaching direction to the valve port 66 against the biasing force of the compulsive opening spring 81, that is, in the direction in which the open area of the supply passage 31 decreases.

On the other hand, the bellows 54 extend and contract in accordance with the change of the suction pressure Ps introduced into the pressure-sensitive chamber 53 through the pressure detecting passage 58.

The load transmitted to the valve body 65 through the pressure-sensitive rod 80 changes in accordance with the extension and contraction of the bellows 54.

In other words, when the suction pressure Ps becomes high, the bellows 54 undergo contraction, and the load in the approaching direction to the valve port 66, that is, the direction in which the open area of the supply passage 31 decreases, is transmitted to the valve body 65. When the suction pressure Ps becomes low, on the other hand, the bellows 54 undergo extension, and the load in the departing direction from the valve port 66, that is, in the direction in which the open area of the supply passage 31 increases, is transmitted to the valve body 65. The control valve 33 operates the valve body 65 by the overall force based on the force of the compulsive opening spring 81 and the follower spring 85 in addition to the impressed load based on the attraction force between both cores 83 and 84 and the impressed load based on the extension and contraction of the bellows 54. In this way, the control valve 33 determines the open area of the supply passage 31.

When the open area of the supply passage 31 inside the control valve 33 becomes small, the amount of the refrigerant gas supplied from the discharge chamber 25 to the crank chamber 15 through the supply passage 31 becomes small. Since a predetermined amount of the refrigerant gas in the crank chamber 15 always flows out into the suction chamber 24 through the bleeding passage 30, the crank chamber pressure Pc inside the crank chamber 15 drops. Therefore, the pressure difference, through the piston 20, between the crank chamber pressure Pc and the pressure inside the cylinder bores 12*a* becomes small, and the tilt angle of the swash plate 18 becomes great. As a result, the stroke of the piston 20 becomes great and the discharge capacity increases.

When the open area of the supply passage 31 inside the control valve 33 becomes great, on the other hand, the amount of the refrigerant gas supplied from the discharge chamber 25 to the crank chamber 15 becomes great. In consequence, the crank chamber pressure Pc of the crank chamber 15 rises. The difference, through the piston 20, between the crank chamber pressure Pc and the pressure of the cylinder bore 12*a* becomes therefore great, and the tilt angle of the swash plate 18 becomes small. As a result, the stroke of the piston 20 becomes small and the discharge amount decreases.

When the cooling requirement inside the cabin is great, the difference between the detection temperature detected by the cabin temperature sensor 41 and the set temperature by the cabin temperature setter 40 becomes great, for example. The greater the difference between the detection temperature and the set temperature, the higher input current value to the coil 86 of the control valve 33 the controlling computer 39 instructs the driving circuit 42. In consequence, the attraction force between the fixed iron core 83 and the movable iron core 84 becomes great and the impressed load to the valve body 65 in the direction for decreasing the open area of the supply passage inside the control valve 33 increases.

Therefore, the control valve 33 lets the bellows 54 operate the valve body 65 with a lower suction pressure Ps as the target (set suction pressure) to open and close the valve hole 66. In other words, the control valve 33 controls the discharge capacity of the compressor in such a manner as to keep a lower suction pressure Ps since the input current value to the coil 86 is increased.

When the cooling requirement inside the cabin is small, on the contrary, the difference between the detection temperature detected by the cabin temperature sensor 41 and the set temperature by the cabin temperature setter 40, for example, becomes small. The smaller the difference between the detection temperature and the set temperature, the lower input current value to the coil 86 of the control valve 33 the controlling computer instructs the driving circuit 42. In consequence, the attraction force between the fixed iron core 83 and the movable iron core 84 becomes small, and the impressed load to the valve body 65 in the direction for decreasing the open area of the supply passage 31 inside the control valve 33 decreases.

Therefore, the control valve 33 lets the bellows 54 operate the valve body 65 with the higher suction pressure Ps as the set suction pressure to open and close the valve hole 66. In other words, the control valve 33 regulates the discharge capacity of the compressor so as to keep the higher suction pressure Ps by decreasing the input current value to the coil 86.

As described above, the opening/closing operation of the supply passage 31 by the bellows 54 in the control valve 33 changes in accordance with the input current value given to the coil 86. When equipped with such a control valve 33, the compressor plays the role of changing the refrigerating capacity in the refrigeration circuit.

Next, the features of this embodiment will be explained.

Figure 4:
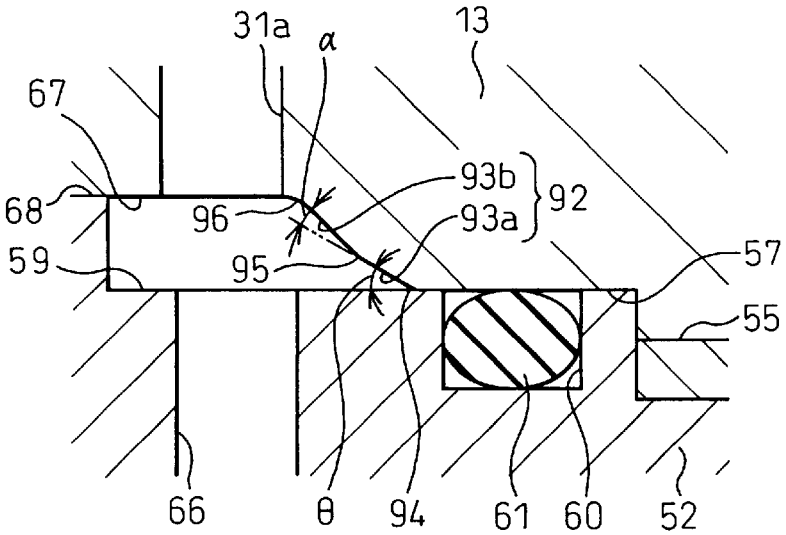
FIG. 4 is a partial sectional view showing in enlargement the step portions shown in FIG. 1 and portions around the former.
Figure 5A:
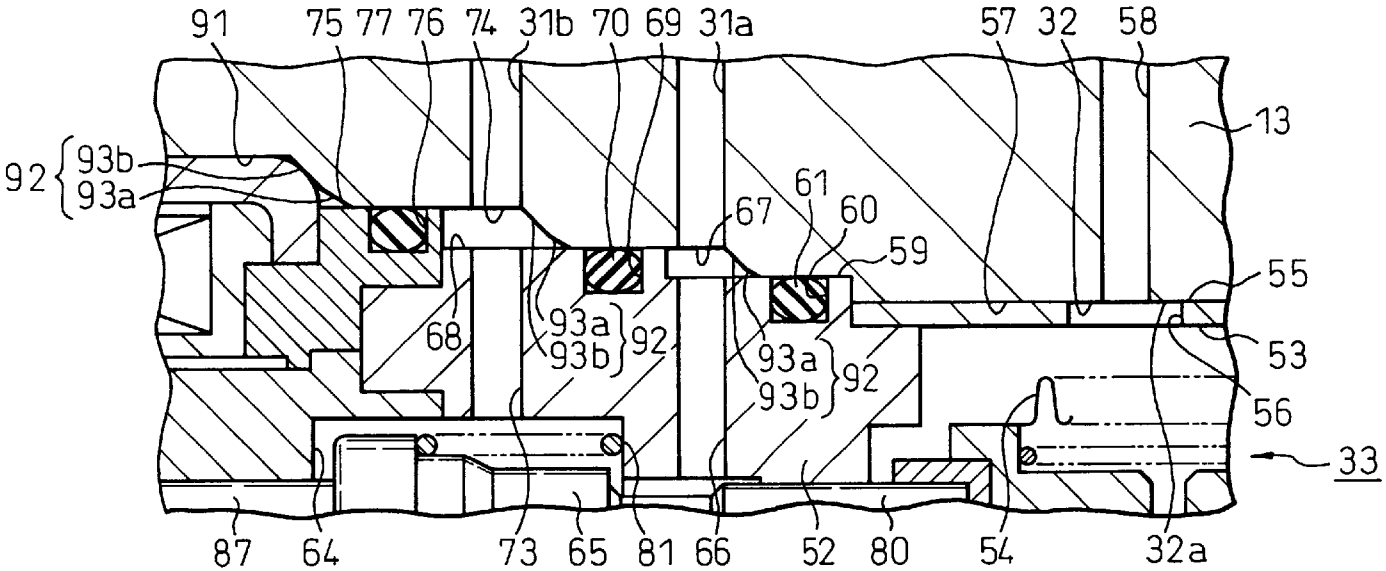
FIG. 5A is a partial sectional view showing in enlargement the principal portions of FIG. 1.

Step portions 92 are formed on the inner peripheral surface 32*a* of the fitting hole 32 between the step surface portions 57 and 67, between 67 and 74, and between the third step surface portion 74 and the fourth step surface portion 91 that is the step surface portion opposing the outer peripheral surface of the electromagnetic driving portion 51 of the control valve 33, as shown in FIGS. 1, 4 and 5A. Each step portion 92 is formed by two adjoining taper surfaces 93*a* and 93*b*, the diameter of which decreases progressively towards the depth of the fitting hole 32.

The first taper surface 93*a* positioned on a deeper side of each step portion 92 has an angle θ of about 15 to 35 degrees, preferably 20 to 30 degrees, with the extension surface of each step surface portion 57, 67, 74, to which it is connected through a continuous curve surface 94 having a predetermined radius of curvature. The inner diameter of the open section of the first taper surface 93*a* on its inlet side is somewhat greater than the outer diameter of each O-ring 61, 70, 77 disposed on each step surface portion 57, 67, 74 continuing the first taper surface 93*a*, under the free condition of each O-ring.

The second taper surface 93*b* positioned on the inlet side of each step portion 92 is connected to the first surface 93*a* through a connecting curve surface 95 having a predetermined radius of curvature. This second taper surface 93*b* is formed so that its angle α with an extension surface of the first taper surface 93*a* is from about 10 to about 25 degrees, preferably 15 to 20 degrees.

In other words, this second taper surface 93*b* is formed so that its inclination to the extension surface of each of the step surface portions 57, 67 and 74 is greater than the inclination of the first taper surface 93*a*. This second taper surface 93*b* continues to each step surface portion 67, 74, 91 on the inlet side through a continuous curve surface 96 having a predetermined radius of curvature.

Because the fitting hole 32 of the compressor is constituted as described above, each O-ring 61, 70, 77 is guided and accommodated reliably into each O-ring holding portion 60, 69, 76 when it passes over the second taper surface 93*b*. Each O-ring 61, 70, 77 is compressed by a predetermined quantity when it passes over the first taper surface 93*a*. Each O-ring is held reliably between each O-ring holding portion 60, 69, 76 of the control valve 33 and each step surface portion 67, 74, 91 of the fitting hole 32 opposing the former. Consequently, each space between each step portion 55, 59, 68 of the control valve and each step surface portion 57, 67, 74 is partitioned in the hermetic condition.

A part of each of the pressure detecting passage 58 and the supply passage 31 is open to only each step surface portion 57, 67, 74 without opening to each taper surface 93*a*, 93*b*. Therefore, each O-ring 61, 70, 77 under the compressed condition does not pass over each passage 31, 58 and is almost free from possible damage.

This embodiment provides the following effects.

In this embodiment, each step portion 92 is formed in the fitting hole 32 of the compressor in such a fashion as to correspond to each O-ring holding portion 60, 69, 76 of the control valve 33. This step portion 92 comprises the two taper surfaces 93*a* and 93*b* the diameters of which decrease progressively from the inlet side to the depth in the inserting direction when the control valve 33 is fitted. The inclination on the second taper surface 93*b* on the inlet side in the inserting direction is greater than that of the first taper surface 93*a* on the depth side.

In other words, the first taper surface 93*a* on the depth side keeps small inclination in the inserting direction of the control valve 33, but the second taper surface 93*b* on the inlet side has a large inclination. Therefore, as the O-rings 61, 70 and 77 are compressed by the first taper surface which has small inclination, the increase of the resistance can be avoided when the control valve 33 is inserted. In other words, the control valve 33 can be fitted easily, and an increase in the production cost of the compressor can be avoided.

Figure 3:
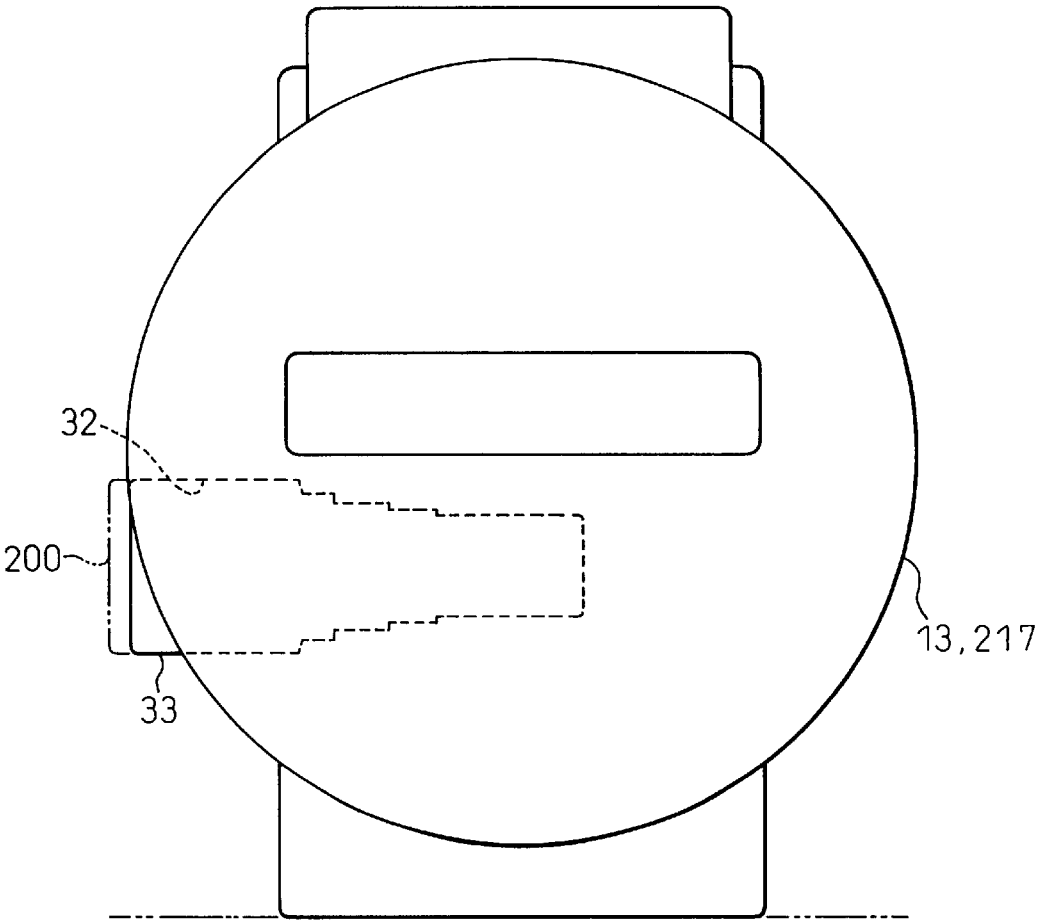
FIG. 3 is a side view of the variable capacity compressor shown in FIG. 2 when it is viewed from a rear housing side.
Figure 5B:
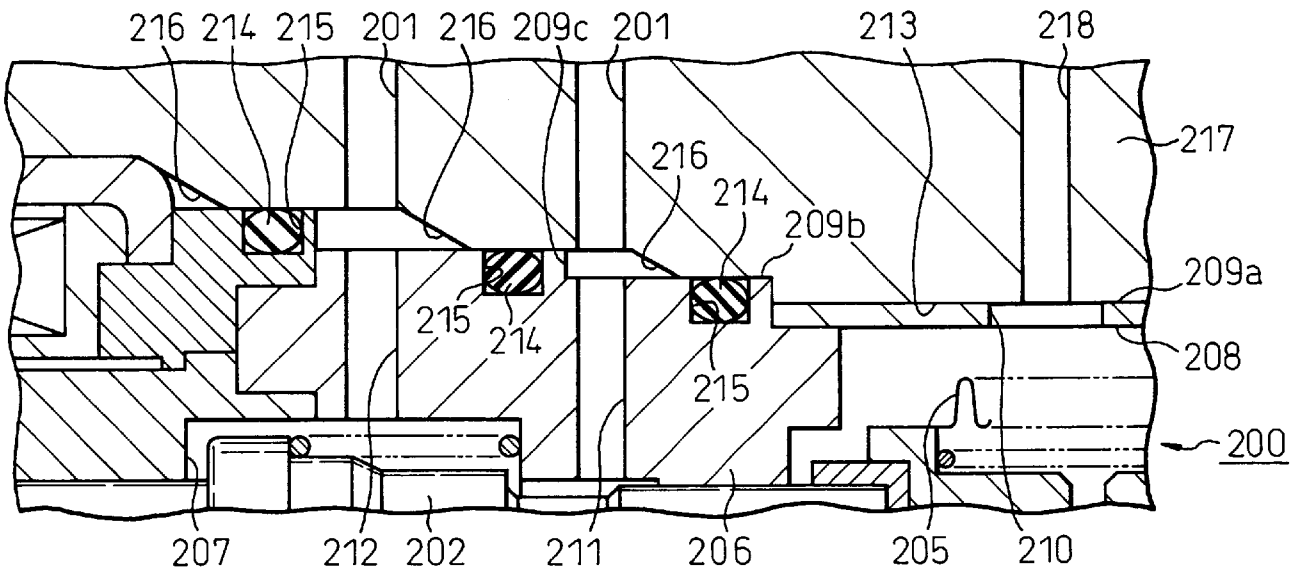
FIG. 5B is a partial enlarged view showing the principal portions of a fitting structure of a control valve according to the prior art.

On the other hand, the inclination of the second taper surface 93*b* on the inlet side is great as shown in FIG. 5A. Therefore, in comparison with the prior art construction in which the taper surface 216 of the fitting hole 213 comprises a single small inclination as shown in FIG. 5B, the width of each step portion 92 can be made smaller. In consequence, as shown in FIG. 3, the length of the control valve 33 in the axial direction can be decreased by the decrease of the width of each step portion 92, and the protruding length of the control valve 33 from the outer periphery of the rear housing 13 can be prevented. Therefore, the requirement for reducing the size of the compressor can be satisfied.

Moreover, the open space of the pressure detecting passage 58 and the supply passage 31 can be secured sufficiently on each step portion 57, 67, 74 of the fitting hole 32 although the distances between the O-rings 61, 70 and 77 become small. In other words, the requirement for machining accuracy of the supply passage 31 does not increase, and the production cost of the compressor does not increase, either.

Furthermore, it is easy to prevent a part of the supply passage 31 from opening to each step portion 92. Therefore, the damage of each O-ring 61, 70, 77 can be avoided, and the occurrence of the pressure leak from the supply passage 31 or the pressure detecting passage 58 can be restricted. Consequently, capacity controllability can be secured, in a stable way, in the compressor.

In the fitting hole 32 of the compressor according to this embodiment, each step portion 92 comprises the two taper surfaces 93*a* and 93*b*.

Even though the construction is extremely simple as described above, the effect described above can be accomplished. Moreover, this fitting hole 32 can be bored easily using one cutting or boring tool corresponding to the shape of its inner peripheral surface 32*a*, for example.

In the fitting hole 32 of the compressor according to this embodiment, each taper surface 93*a*, 93*b* is connected through the predetermined connecting curve surface 95.

Therefore, each taper surface 93*a*, 93*b* can be connected smoothly, and it becomes possible to avoid more effectively the increase of the resistance at the time of fitting of the control valve 33 and to avoid the possible damage of each O-ring 61, 70, 77.

Consequently, the production cost can be further reduced in the compressor and stability of its capacity control can be further improved.

In the fitting hole 32 of the compressor according to this embodiment, the inner diameter on the inlet side is somewhat greater than the outer diameter of each O-ring 61, 70, 77, in the free condition, on each first taper surface 93*a* on the depth side of each step portion 92. The inner diameter on the depth side of the first taper surface 93*a* is smaller than the outer diameter of each O-ring in a free condition.

Therefore, the second taper surface 93*b* on the inlet side does not compress each O-ring 61, 70, 77 but only guides them. The first taper surface 93*a* on the depth side plays the role of reliably compressing each O-ring 61, 70, 77. In consequence, each O-ring 61, 70, 77 can be reliably accommodated in each O-ring holding portion 60, 69, 76 of the control valve 33.

Therefore, air-tightness at each step portion 55, 59, 68 of the control valve 33, to which the pressure-sensitive hole 56 communicating with the pressure-sensitive chamber 53 and the supply hole 73 communicating with the valve port 66 and with the valve chest 64 are open, can be secured. In consequence, the occurrence of the pressure leak in the pressure detecting passage 58 and in the supply passage 31 can be prevented, and stable capacity controllability of the compressor can be secured.

In the fitting hole 32 of the compressor according to this embodiment, the pressure detecting passage 58 communicating with the suction chamber 24, the downstream side supply passage 31*b* communicating with the crank chamber 15 and the upstream side supply passage 31*a* communicating with the discharge chamber 25, are open only to the step surface portions 57, 67 and 74, respectively.

Therefore, a part of each passage 58, 31*b*, 31*a* is not open to each step portion 92, and the damage of each O-ring 61, 70, 77 can be avoided more reliably.

In the fitting hole 32 of the compressor according to this embodiment, each taper surface 93*a*, 93*b* continues each step surface portion 57, 67, 74, 91 through each predetermined continuous curve surface 94, 96.

Therefore, the resistance at the time of fitting of the control valve 33 can be further reduced, and the improvement in assembling the control valve 33 can be accomplished.

Incidentally, the embodiment of the present invention described above may be modified in the following ways.

Figure 6:
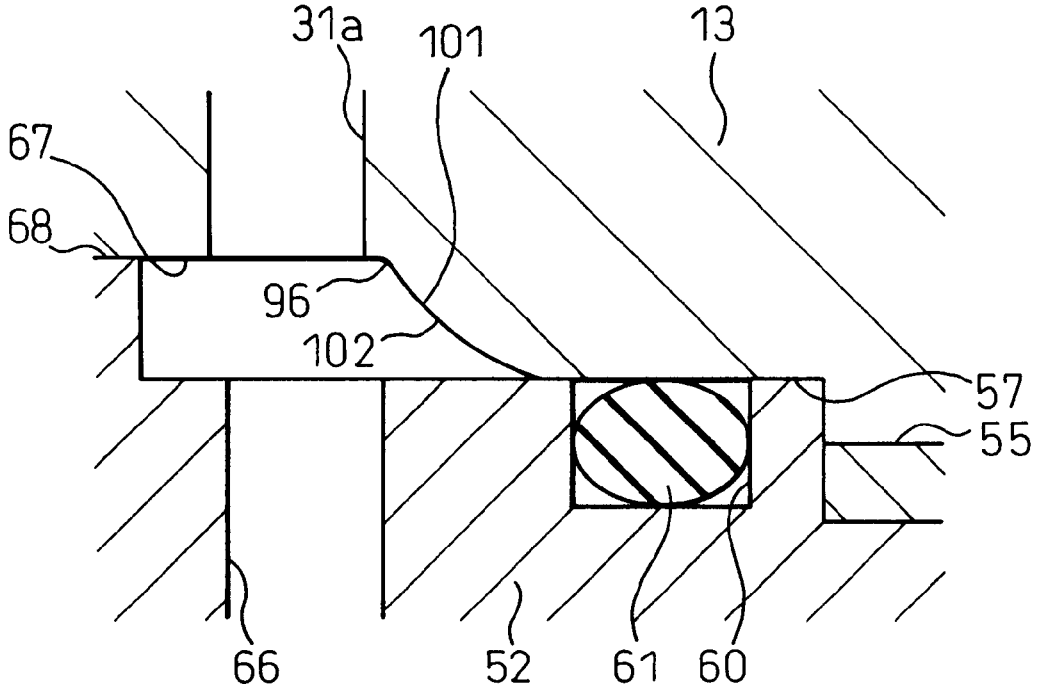
FIG. 6 is a partial sectional view showing in enlargement the principal portions of the fitting structure of the control valve according to a modified embodiment of the present invention.
Figure 7:
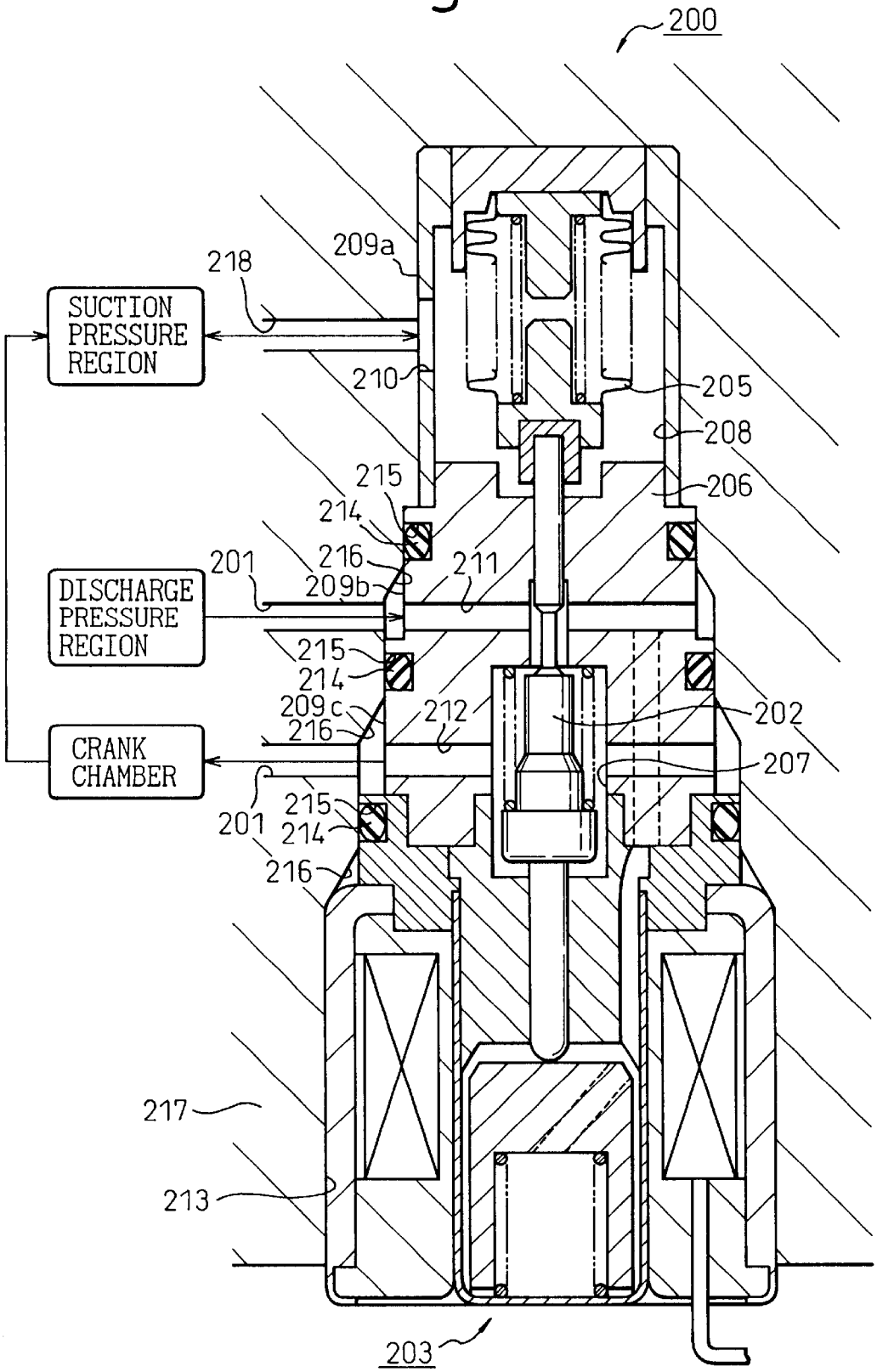
FIG. 7 is a sectional view showing the fitting structure of the control valve according to the prior art.

In the embodiment described above, the step portion 92 of the fitting hole 32 comprises the two taper surfaces 93*a* and 93*b*. In contrast, the step portion 101 may comprise an elliptical surface 102 having, as a guide line, an ellipse the radius of curvature of which increases gradually from the inlet side to the depth side of the fitting hole 32, for example, as shown in FIG. 6. The step portion 101 may also comprise a curvature having, as a guide line, a curve the radius of which becomes gradually greater, such as a parabola, an involute curve, a spiral line, one of the hyperbola, and so forth.

In such a case, the inclination of the step portion 101 with respect to the inserting direction of the control valve 33 can be increased at the inlet side while avoiding the increase of the resistance to the insertion of the control valve 33 at the depth of the step portion 101 is avoided. Therefore, the width of the step portion 101 can be further decreased, and the length of the control valve 33 in the axial direction can be further decreased.

Therefore, the protruding distance of the control valve 33 on the outer peripheral portion of the rear housing 13 can be further limited.

In the embodiment described above, the step portion 92 of the fitting hole 32 comprises the two taper surfaces 93*a* and 93*b*. However, the step portion 92 may comprise three or more taper surfaces that are serially connected to one another in such a fashion that the inclination in the inserting direction of the control valve 33 becomes small.

This construction provides substantially the same effects as the effects of the modified embodiments given above.

The embodiment given above embodies concretely the fitting structure of the control valve 33 for controlling the discharge capacity of the compressor on the basis of both the change of the suction pressure Ps and the signals from outside the compressor. However, the present invention may be embodied into the fitting structure of the control valve for controlling the discharge capacity of the compressor that is based on either one of the change of the suction pressure Ps and the signals from outside the compressor.

The embodiment given above embodies the present invention into the fitting structure of the control valve for changing the feed quantity of the refrigerant gas from the discharge chamber 25 into the crank chamber 15. However, the present invention may be embodied into the fitting structure of the control valve for changing the release quantity of the refrigerant gas from the crank chamber 15 into the suction chamber 24.

The embodiment given above embodies the present invention into the fitting structure of the control valve of the single head piston- and swash plate-type variable capacity compressor, but the present invention may be embodied into the fitting structure of a double-head piston, swash plate-type variable capacity compressor, a wobble type variable capacity compressor, and so forth.

While the present invention has thus been described by reference to one specific embodiment chosen for purposes of illustration, it should be apparent that numerous modifications could be made thereto by those skilled in the art without departing from the basic concept and scope of the invention.

What is claimed is:

1. A fitting structure of a control valve in a variable capacity compressor of the type which control valve includes a plurality of step portions in appearance and in which a hole communicating with a gas chamber defined inside said control valve is open to at least one of said step portions and each of said step portions is partitioned by a seal member under the condition where said control valve is fitted into a fitting hole of said variable capacity compressor, wherein:

said fitting hole has a plurality of step portions so formed as to correspond to seal member holding portions of said control valve, each of said step portions is shaped into an inclined surface the diameter of which progressively decreases from the inlet side towards the bottom in an inserting direction of said control valve, and a diameter reduction amount on said inclined surface is greater on the inlet side of said inclined surface than the bottom side.

2. A fitting structure of a control valve according to claim 1, wherein said inclined surface comprises a plurality of taper surfaces.

3. A fitting structure of a control valve according to claim 2, wherein each of said taper surfaces is connected through a predetermined connecting curve surface.

4. A fitting structure of a control valve according to claim 2, wherein said taper surface at the deepest part among said taper surfaces is shaped so that the inner diameter thereof on the inlet side is greater than the outer diameter of said seal member under the free condition, and the inner diameter at a bottom part thereof is smaller than the outer diameter of said seal member under the free condition.

5. A fitting structure of a control valve according to claim 3, wherein said taper surface at the deepest part among said taper surfaces is shaped so that the inner diameter thereof on the inlet side is greater than the outer diameter of said seal member under the free condition, and the inner diameter at a bottom part thereof is smaller than the outer diameter of said seal member under the free condition.

6. A fitting structure of a control valve according to claim 1, wherein each of communication passages communicating with a plurality of pressure chambers defined inside said variable capacity compressor is open to one of step surface portions continuing each of said step portions, respectively.

7. A fitting structure of a control valve according to claim 2, wherein each of communication passages communicating with a plurality of said pressure chambers defined inside said variable capacity compressor is open to one of said step surface portions continuing each of said step portions, respectively.

8. A fitting structure of a control valve according to claim 3, wherein each of communication passages communicating with a plurality of said pressure chambers defined inside said variable capacity compressor is open to one of said step surface portions continuing each of said step portions, respectively.

9. A fitting structure of a control valve according to claim 4, wherein each of communication passages communicating with a plurality of pressure chambers defined inside said variable capacity compressor is open to one of said step surface portions continuing each of said step portions, respectively.

10. A fitting structure of a control valve according to claim 1, wherein said inclined surfaces of said step portions and the inner peripheral surfaces of said step surface portions continuing said step portions are connected continuously to each other through a predetermined continuous curve surface.

11. A fitting structure of a control valve according to claim 2, wherein said inclined surfaces of said step portions and the inner peripheral surfaces of said step surface portions continuing said step portions are connected continuously to each other through a predetermined continuous curve surface.

12. A fitting structure of a control valve according to claim 3, wherein said inclined surfaces of said step portions and the inner peripheral surfaces of said step surface portions continuing said step portions are connected continuously to each other by a predetermined continuous curve surface.

13. A fitting structure of a control valve according to claim 4, wherein said inclined surfaces of said step portions and the inner peripheral surfaces of said step surface portions continuing said step portions are connected continuously to each other by a predetermined continuous curve surface.

14. A fitting structure of a control valve in a variable capacity compressor of the type which control valve includes a plurality of step portions in appearance and in which a hole communicating with a gas chamber defined inside the control valve is open to at least one of said step portions and each of said step portions is partitioned by a seal member under the condition where said control valve is fitted into a fitting hole of said variable capacity compressor, wherein:

said fitting hole has a plurality of step portions so formed as to correspond to seal member holding portions of said control valve, and a curve surface having different radii of curvature from the inlet side towards the depth are formed in each of said step portions in an inserting direction of said control valve.

* * * * *